US007530123B2

(12) United States Patent
Cao et al.

(10) Patent No.: US 7,530,123 B2
(45) Date of Patent: May 12, 2009

(54) AUTOMATIC DRAIN

(76) Inventors: Zheng Cao, 5417 Highlands Dr., McKinney, TX (US) 75070; Zhongyan Lv, A602 11 Building Lvyinshanzhuang No, 45 Huanshan, Ronggui Twon, Shunde District, Foshan City, Guangdong (CN)

( * ) Notice: Subject to any disclaimer, the term of this patent is extended or adjusted under 35 U.S.C. 154(b) by 0 days.

(21) Appl. No.: 11/940,078

(22) Filed: Nov. 14, 2007

(65) Prior Publication Data

US 2008/0098516 A1 May 1, 2008

Related U.S. Application Data

(63) Continuation of application No. PCT/CN2006/003559, filed on Dec. 22, 2006.

(30) Foreign Application Priority Data

Dec. 23, 2005 (CN) ..... 2005 2 0145320
Dec. 22, 2006 (CN) ..... PCT/CN2006/003559

(51) Int. Cl.
*E03C 1/23* (2006.01)

(52) U.S. Cl. ..... 4/693; 4/688; 4/689; 4/679; 4/295

(58) Field of Classification Search ..... 4/321, 4/323, 427, 668, 669, 679–684, 687–689, 4/692, 693, 295
See application file for complete search history.

(56) References Cited

U.S. PATENT DOCUMENTS

| | | | | |
|---|---|---|---|---|
| 3,314,085 | A * | 4/1967 | Minella | 4/689 |
| 5,363,519 | A * | 11/1994 | Husting | 4/689 |
| 5,640,724 | A * | 6/1997 | Holmes | 4/689 |
| 6,195,819 | B1 * | 3/2001 | Wang | 4/689 |
| 6,282,730 | B1 * | 9/2001 | Duncan | 4/688 |
| 6,651,272 | B2 * | 11/2003 | Bowman | 4/679 |

FOREIGN PATENT DOCUMENTS

| | | |
|---|---|---|
| DE | 2813088 A1 | 10/1979 |
| DE | 20013323 U | 12/2001 |
| JP | 5-148875 | 6/1993 |

OTHER PUBLICATIONS

International Searching Authority—P.R. China—The State Inellectual Property Office, International Search Report, International Application No. PCT/CN2006/003559, Mar. 20, 2007, 6 pages, Beijing, China.

* cited by examiner

*Primary Examiner*—Tuan N Nguyen
(74) *Attorney, Agent, or Firm*—Haynes and Boone, LLP

(57) ABSTRACT

An automatic drain device for a sink and especially a sink without an overflow hole is provided. The device includes a magnetically controlled valve to open a return path for the flow of overflow fluid to the draining pipe. When the sink is about to overflow, water pressure increases causing the valve in the magnetically controlled valve to open a bypass path to the drain.

21 Claims, 12 Drawing Sheets

AUTOMATIC DRAIN

CROSS REFERENCES

This application is a United States national phase continuation application of co-pending international patent application number PCT/CN2006/003559, filed Dec. 22, 2006, which claims priority to Chinese patent application number 200520145320.2, filed Dec. 23, 2005, the disclosures of which are incorporated herein by reference.

TECHNICAL FIELD

This invention involves a drain system which prevents overflow by utilizing a magnetic device.

BACKGROUND

Traditional sinks have drains with manually operated stoppers. Some of these sinks have an additional, overflow hole near the upper edge of the sink to prevent accidental overflow. Some newer glass bowl sinks, other decorative sinks, and other traditional sinks do not have overflow holes. Neither the sink with drain only, nor the sink with drain plus overflow hole configuration is very reliable at preventing overflow. Sink overflows result in unnecessary and preventable waste and damage.

SUMMARY

A novel automatic drain and valve are disclosed herein, for use in conjunction with a manual drain valve on sinks with or without overflow holes. A typical manual drain valve allows waste water to pass from a sink to a drain pipe. According to the present disclosure, a bypass port is located above the manual drain valve poppet to allow the waste water to pass to the automatic valve when the manual drain valve is closed. The automatic valve is also connected to the drain pipe via an alternate drain path. The alternate drain path returns to the drain pipe below the manual valve, thus effecting a bypass around the closed manual drain.

Another aspect of the present invention is to provide an automatic drain device for a sink comprising a manual drain valve, which when closed, is operable to shut-off fluid drain to a drain pipe. The device also includes an automatic magnetic valve in fluid communication with the drain pipe and operable to automatically open a bypass drain path for overflow fluid from the sink to the drain pipe when the manual drain valve is closed.

A further aspect of the present invention is to provide a method to automatically drain a sink with an automatic drain comprising the steps of: closing a manual drain valve, allowing water to accumulate in the sink, and automatically opening a bypass drain path to the drain pipe when the water in the sink is at or above an overflow level.

Additional aspects will become more readily apparent from the detailed description and drawings.

BRIEF DESCRIPTION OF THE DRAWINGS

Aspects and configurations of the disclosure will become more apparent from the detailed description set forth below when taken in conjunction with the drawings in which like reference characters identify corresponding elements throughout.

DETAILED DESCRIPTION

Figure 1:
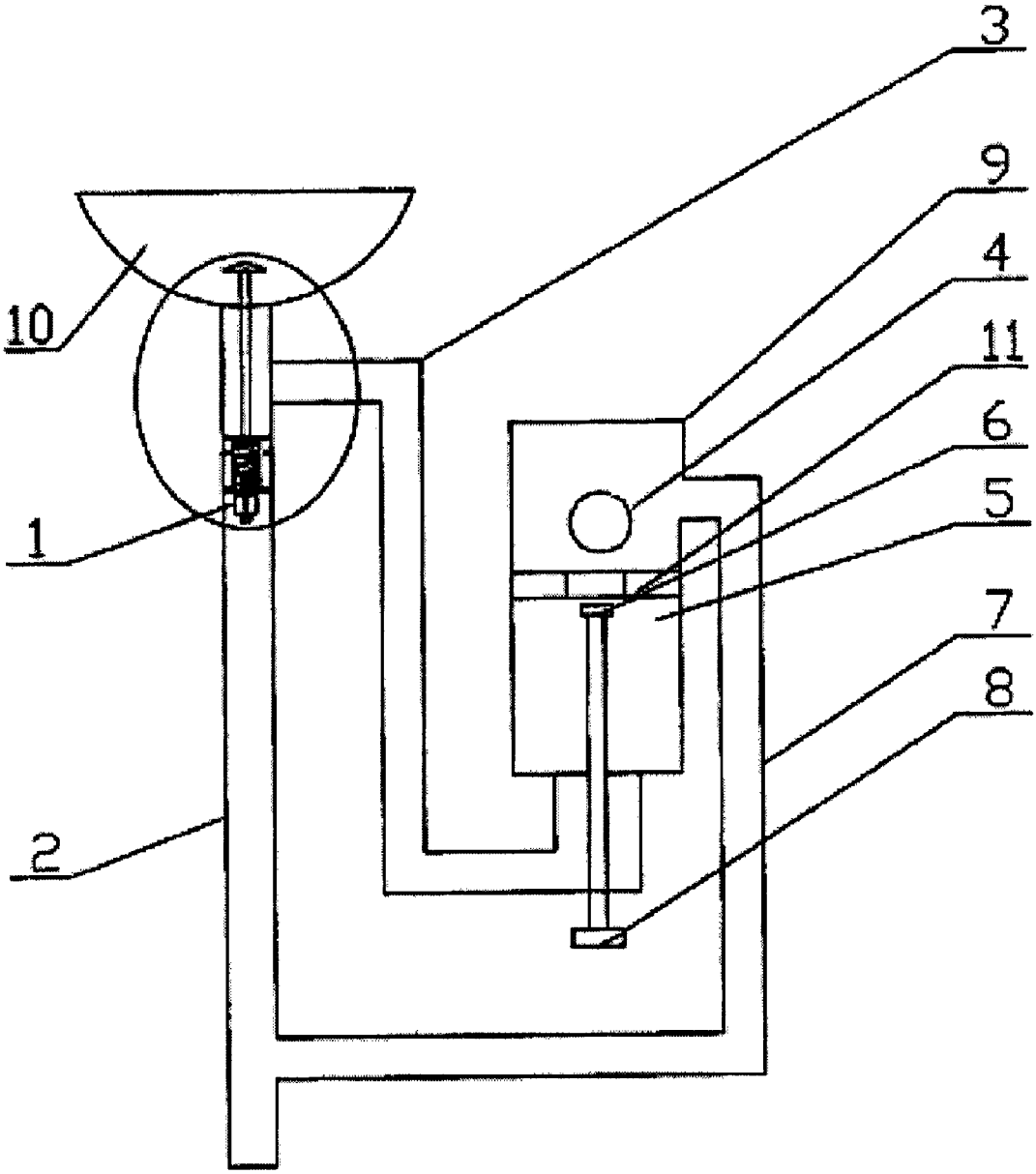
FIG. 1 illustrates an automatic drain device according to an exemplary embodiment.

As shown in FIG. 1, the automatic drain device includes a manual drain valve 1 and an automatic drain valve 5, both connected to drain pipe 2. Water, or fluid from sink 10 enters manual drain valve 1 and passes through to the drain pipe 2 if the manual drain valve 1 is open.

The manual drain valve 1 is further described with reference to FIGS. 2 and 3. The manual drain valve 1 can be the press-down type which is well-known in the industry. The manual drain valve 1 includes drain cover 18 which functions as a press-down button. The drain cover 18 is coupled to a valve stem 19 which is linked to lower body 17 via the stopper hinge 20. The valve stem and lower body 17 are supported by support member 21 which is attached to a portion of drain pipe 2.

The lower body 17 of the manual drain valve 1 can move relative to the valve stem 19, but they are held apart by spring 15 which is coupled to the valve stem 19. A poppet 13 is attached to the valve stem 19 between the drain cover 18 and the spring 15. Poppet 13 closes the fluid path through the valve when it is held against the valve seat 12 by the stopper hinge 20.

In one embodiment, the lower end of valve stem 19 has a groove 16 for containing one end of stopper hinge 20. The other end of the stopper hinge 20 is connected to lower body 17. Optionally, a magnet (not show in FIG. 2 or 3) may be included on the back of groove 16 to attract the stopper hinge 20 and prevent it from slipping off.

Figure 2:
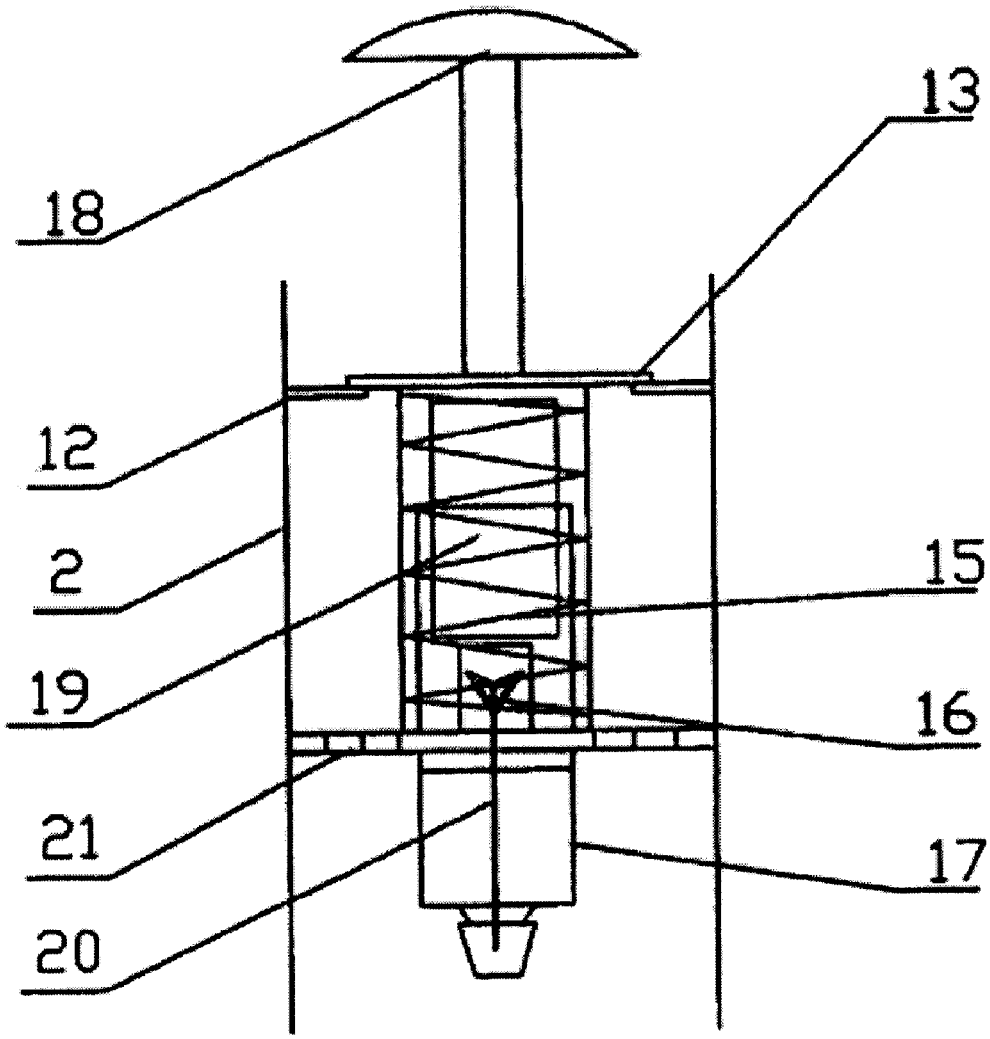
FIG. 2 illustrates the manual shutoff valve of FIG. 1 in a closed position.
Figure 3:
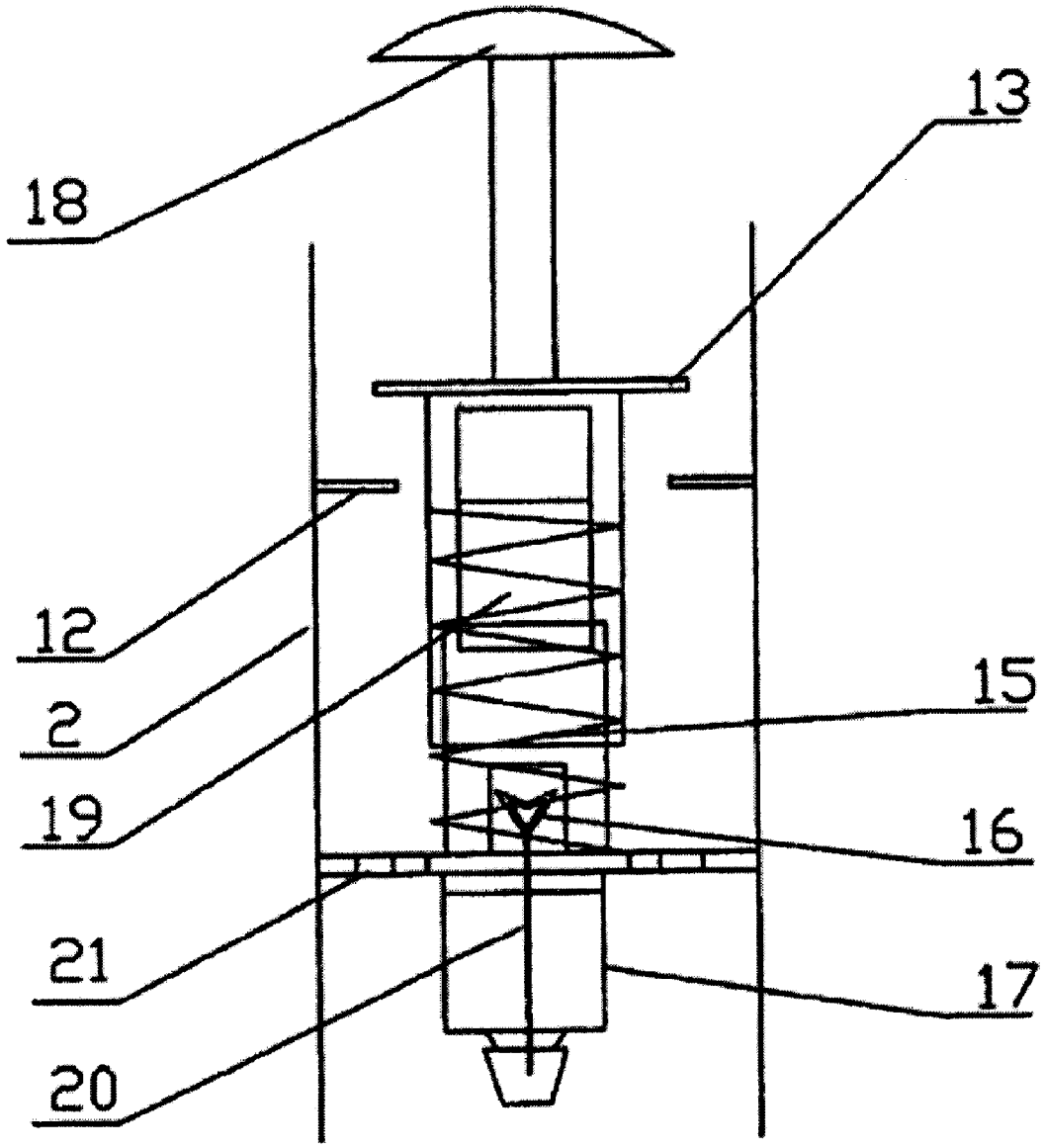
FIG. 3 illustrates the manual shutoff valve of FIG. 1 in an open position.

As illustrated in FIG. 2, depression of drain cover 18 allows the stopper hinge 20 to latch in a closed position with the poppet 13 pressed into valve seat 12. By slightly depressing the drain cover 18 again, the stopper hinge 20 releases the valve stem 19 upwards to an open position as illustrated in FIG. 3. In the open position, the poppet 13 is separated from the valve seat 12 allowing fluid to pass therebetween. The fluid then passes the support member 21 and flows down drain pipe 2.

When the manual drain valve 1 is closed, the water or fluid in the sink can accumulate. If the water level in the sink begins to spill over the top of the sink an overflow level has been reached. An overflow level can be reached even in a sink with an overflow hole if the rate of inflow exceeds the rate of drainage through the overflow hole. When the water is maintained at a user-determined level that is below the top of the sink, the water or fluid is at a safety level.

The automatic drain disclosed herein can help maintain the water or fluid level in the sink at a safety level by connecting a bypass line 3 above the manual drain poppet 13. Thus, when the manual drain valve 1 is closed, water will travel through the bypass line 3 towards automatic drain valve 5. The bypass line 3 is connected to a lower body portion of the automatic drain valve 5. The lower and upper body portions of the automatic drain valve 5 are separated by a float valve seat 11 with corresponding float stopper 4, designed to seal against the float valve seat 11. A return line 7 connects the upper body portion of the automatic drain valve 5 to the drain pipe 2 at a location beyond the manual drain valve 1.

When the automatic drain valve 5 is empty, the float stopper 4 seals the drain by seating against the float valve seat 11. The float stopper 4 is held against valve seat 11 by gravity and magnetism. As the float stopper 4 comprises at least some amount of ferrous material it has a weight and is attractable by a magnet force. In the automatic drain valve 5, a float control magnet 6 is located opposite the float stopper 4 in the lower body portion. The float control magnet 6 is connected to a height adjustable overflow level slide 8. The retaining force of the float stopper 4 against the float valve seat 11 can be changed by altering the distance between the float stopper 4 and the float control magnet 6. As the distance between the float stopper 4 and the float control magnet 6 decreases by moving the overflow level slide 8 towards the float valve seat 11, the retaining force is increased.

The float stopper 4 additionally includes enough material which is less dense than water to allow it to float. Thus, when the manual drain valve 1 is closed, the water in sink 10 begins to exert an upward pressure on the float stopper 4. When the safety level is exceeded, the pressure of the fluid in the sink creates buoyancy pressure sufficient to overcome the gravity and magnetic force acting on the float stopper 4. The float stopper 4 is lifted away from the float valve seat 11 and the water is then able to fill the upper body portion of the automatic drain valve 5 and exit through the return line 7 to the drain pipe 2. An air inlet 9 may be provided at the top of the automatic drain valve 5 to allow the water to fully exit the return line 7 and the drain pipe 2 when both valves 1,5 are closed.

As the water level in the sink decreases, so does the buoyancy pressure it is able to exert on the float stopper 4. Once the water level is at or below the safety level, the float control magnet 6 and gravity exert enough force on the float stopper 4 to overcome the buoyancy pressure and re-seat the float stopper 4 against the float valve seat 11. Thus, the water level in the sink 10 may be adjusted by moving the overflow level slide 8 in and out.

The automatic drain works as follows: when the drain cover 18 is pressed down, overcoming the resistance of spring 15, the poppet 13 and the valve stem 19 move downward relative to the valve lower body 17. The stopper hinge 20 stops at an upper stopping point in groove 16. The stopper hinge 20 moves within the upper stopping point and lower stopping point within groove 16, and a magnet installed on the back of the groove 16 ensures the stopper hinge 20 does not fall off the groove 16. Thus, the poppet 13 is pressed against the valve seat, shutting off flow to the drain pipe 2.

If water continues to enter the sink, the water will enter into automatic drain valve 5 through the bypass line 3. Initially, the water way will be shutoff due to the attraction by the float control magnet 6 on the float stopper 4.

As water continues to enter the sink, the safety level is exceeded, resulting in a pressure sufficient to overcome the float control magnet 6, lifting float stopper 4 away from the float valve seat 11. Hence, the water is able to pass through the automatic drain valve 5 to the return line 7 and is drained through drain pipe 2.

When the water level in sink 10 is reduced, and the water level is lowered to the safety level, the water pressure is reduced. Float control magnet 6 attracts the float stopper 4 back to the float valve seat 11, stopping the water flow. When water is continuously added into the sink, the system works automatically. The water safety level in the sink 10 can be set and adjusted by using the overflow level slide 8.

When the drain cover 18 is pressed again, poppet 13 and the valve stem 19 move upward with the spring 15 relative to lower valve body 17. The stopper hinge 20 leaves an upper stopping point and returns to a lower stopping point, the poppet 13 separates from the valve seat 12, and the water is drained through drain pipe 2.

Figure 4:
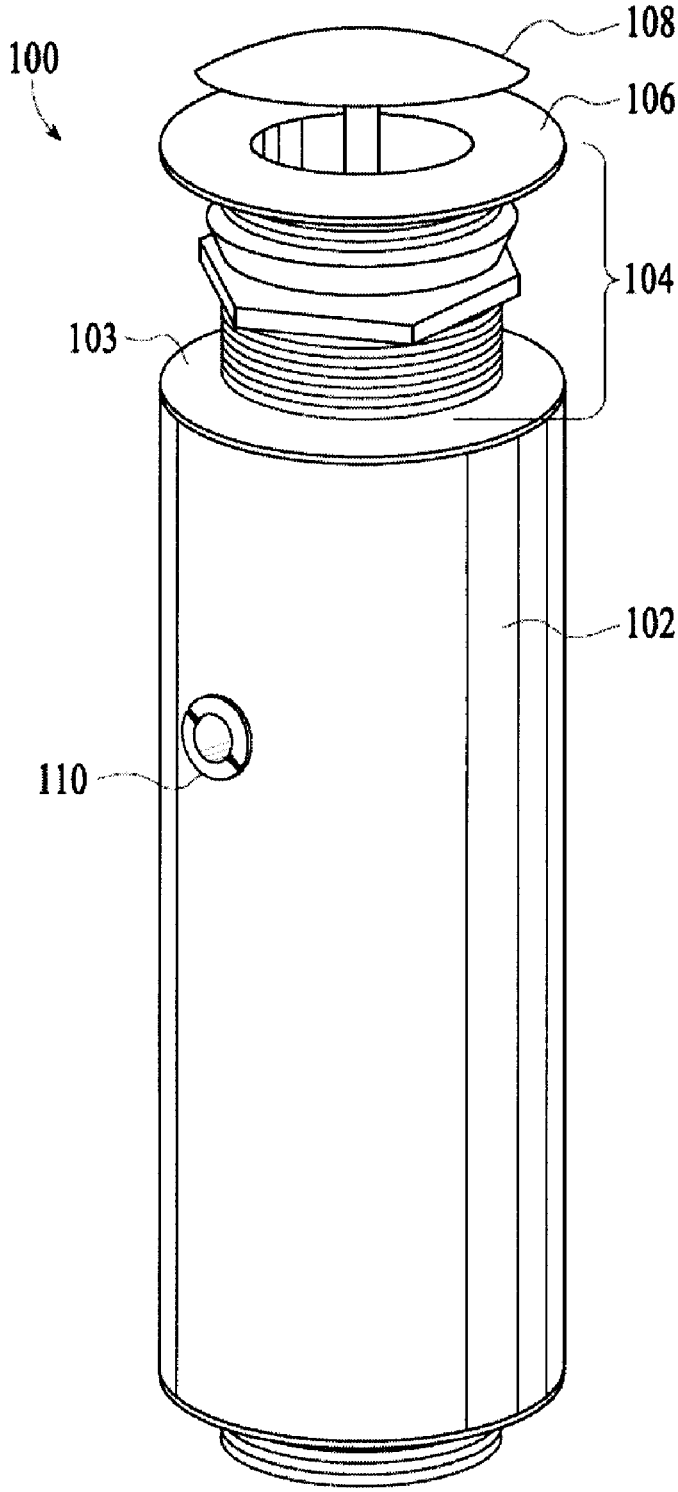
FIG. 4 illustrates a perspective view of an automatic drain device in accordance with another embodiment.

FIGS. 4 through 12 illustrate views of an automatic drain 100 in accordance with another exemplary embodiment. Referring to FIG. 4, the automatic drain 100 includes a manual drain valve 120 (shown in FIG. 6) and an automatic drain valve 150 (shown in FIG. 6), both housed within a valve sleeve 102. The valve sleeve 102 is a tubular structure or sleeve having coupled to a top end thereof, mounting hardware 104 for placement or installation of a sink. The valve sleeve 102 is penetrated by air inlet fitting 110. A drain flange 106 is included and is arranged to align with the drain outlet of the sink to permit water to drain therethrough. The drain flange 106 may be a ring that can be recessed in a drain seat of the sink.

The mounting hardware 104 and drain flange 106 have a through-hole aligned with a central (longitudinal) axis of the valve sleeve 102. A shoulder 103 exists between the mounting hardware 104 and an upper end of the valve sleeve 102. The drain cover 108 is shown above drain flange 106. The drain cover 108 is intended to be placed in the sink to manually actuate the manual drain valve 120 and to provide a decorative cover for the drain hole. The operation of the drain cover 108 and the manual drain 120 are described above in conjunction with the first embodiment.

Figure 5:
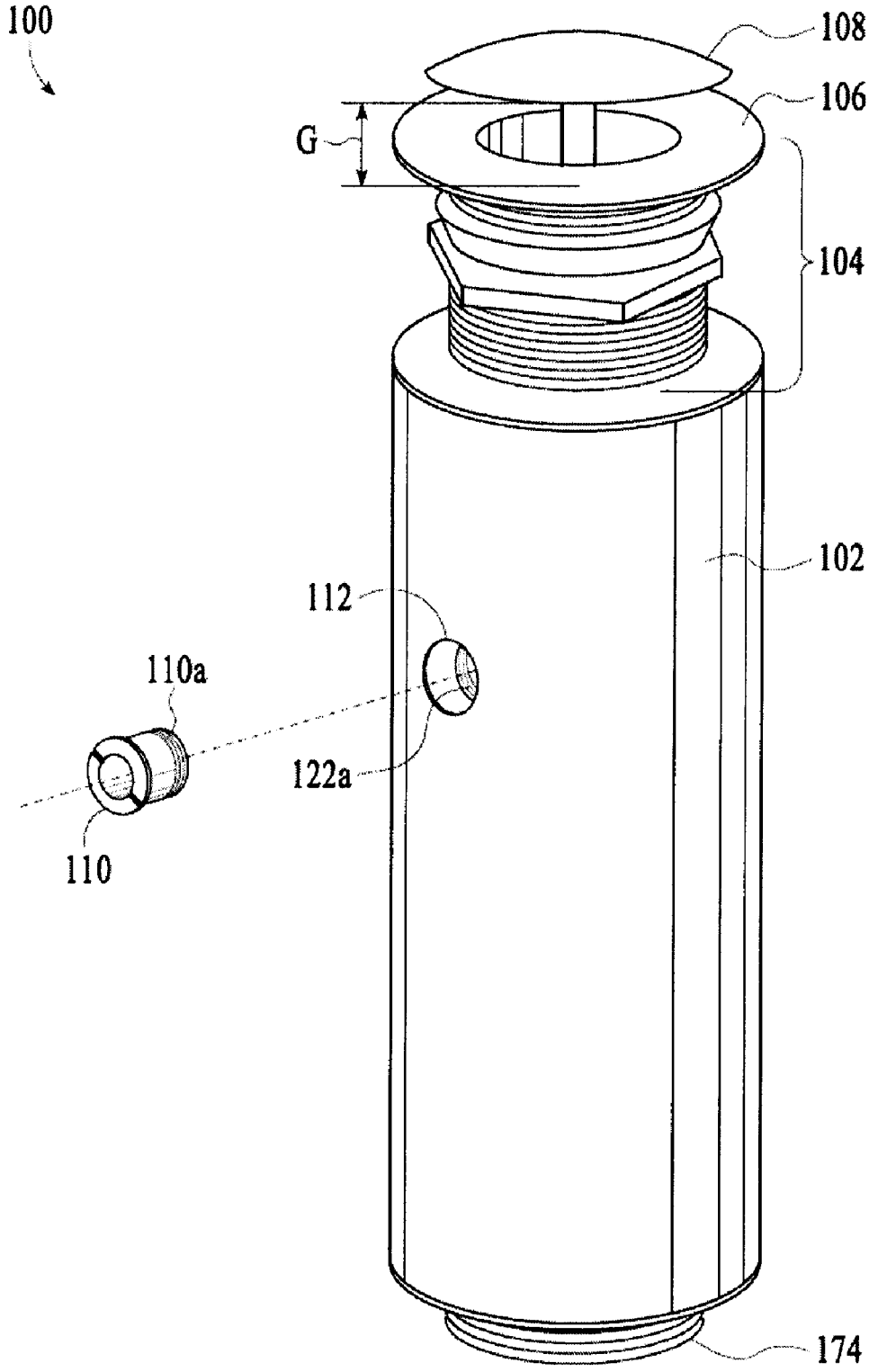
FIG. 5 illustrates a perspective view of the automatic drain device of FIG. 4 with a fitting for a breather hole exploded from the device housing.

Turning now to FIG. 5, when the manual drain valve 120 is in a closed position attained by pressing down drain cover 108, a small gap G exists between the bottom of the drain cover 108 and the top surface of the drain flange 106 to permit water to escape. When the manual drain valve 120 is in an open position attained by re-pressing drain cover 108, the gap G is larger to permit the water to drain more rapidly.

FIG. 5 illustrates additional features of the air inlet fitting 110. Air inlet fitting 110 is shown exploded from the valve sleeve 102. The air inlet fitting 110 has threads 110*a* which mate with threads 122*a* of the manual drain valve 120. Air inlet fitting 110 passes through aperture 112 before it is threaded to the manual drain valve 120.

Figure 6:
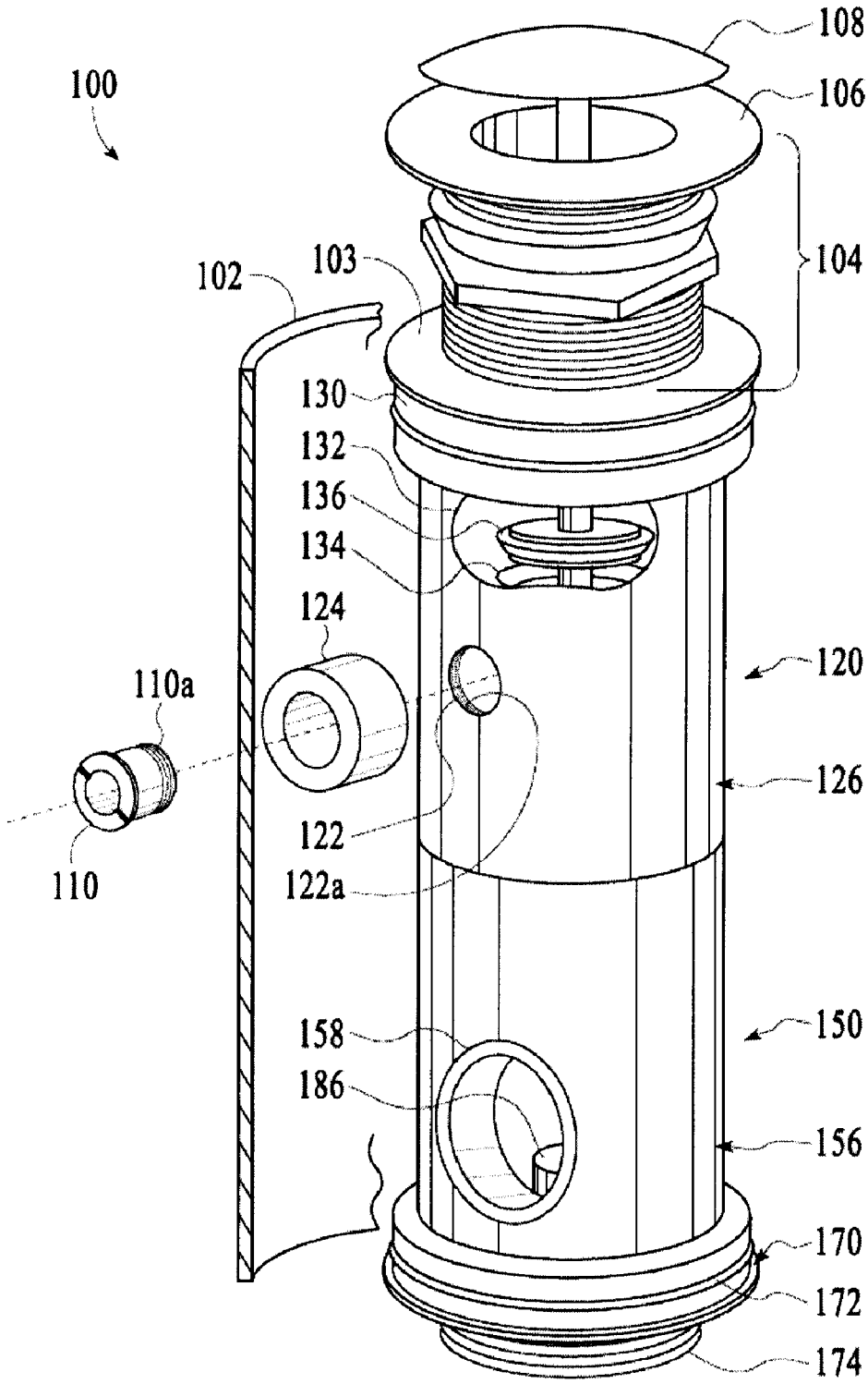
FIG. 6 illustrates a perspective view of the automatic drain device of FIG. 4 with a portion of an exterior device housing removed.

FIG. 6 illustrates a perspective view of the automatic drain 100 with a portion of a valve sleeve 102 removed showing the manual drain valve 120 stacked above the automatic drain valve 150. As shown in FIGS. 5 and 6, aperture 112, which is formed in the valve sleeve 102, aligns with breather hole 122.

Breather hole 122 has female threads 122*a* which matingly receive threads 110*a* of air inlet fitting 110. A grommet 124 is provided to seal breather hole 122 against water flowing between the valve sleeve 102 and the manual valve body 126, and between the valve sleeve 102 and the automatic valve body 156.

In general, valve bodies 126 and 156 are concentric with the valve sleeve 102. The stacked valve bodies 126 and 156 serve as a primary drain pipe (as shown by flow line A in FIG. 9). A gap or space is formed between the interior circumferential surface of the valve sleeve 102 and the exterior circumferential surface of valve bodies 126, 156 to permit overflow water to flow to the automatic drain valve 150.

Figure 7:
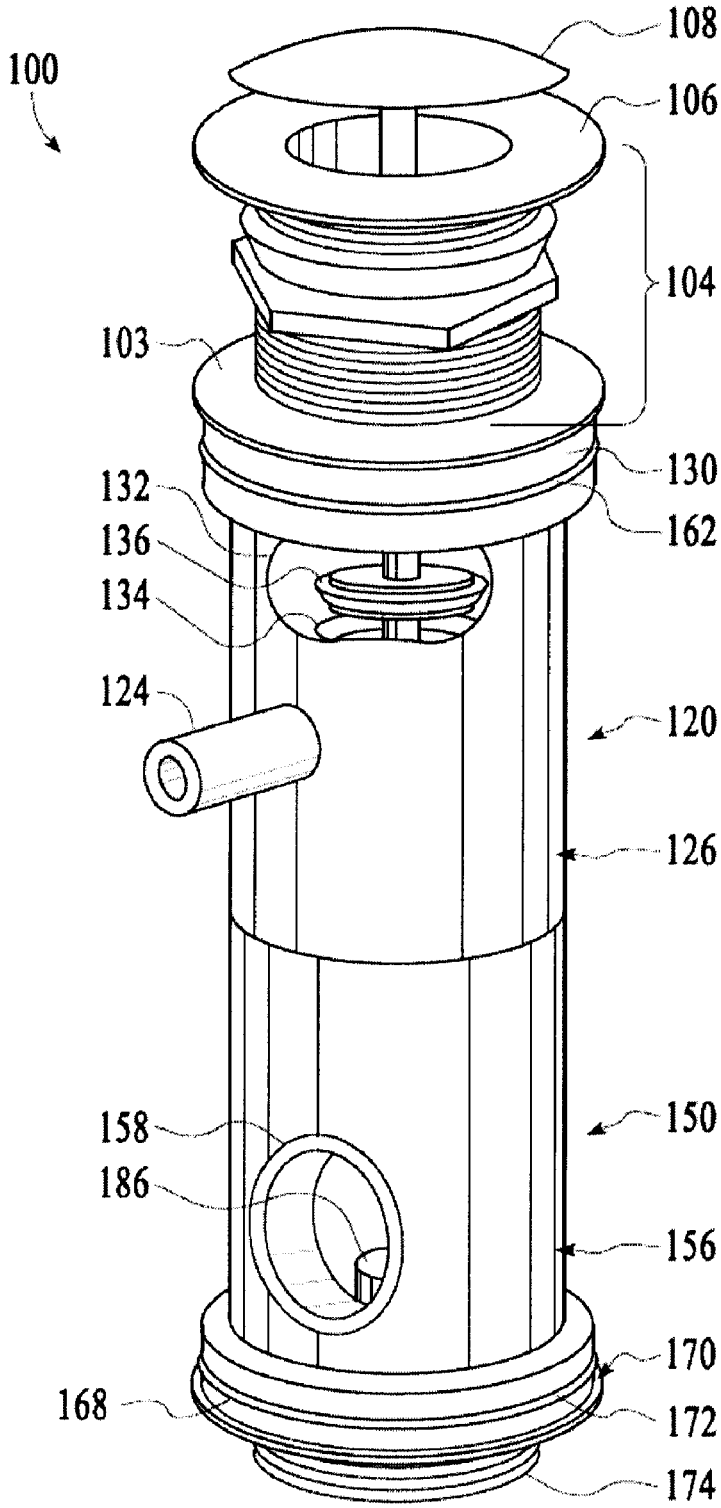
FIG. 7 illustrates a perspective view of the automatic drain device of FIG. 4 with the exterior housing completely removed.
Figure 8:
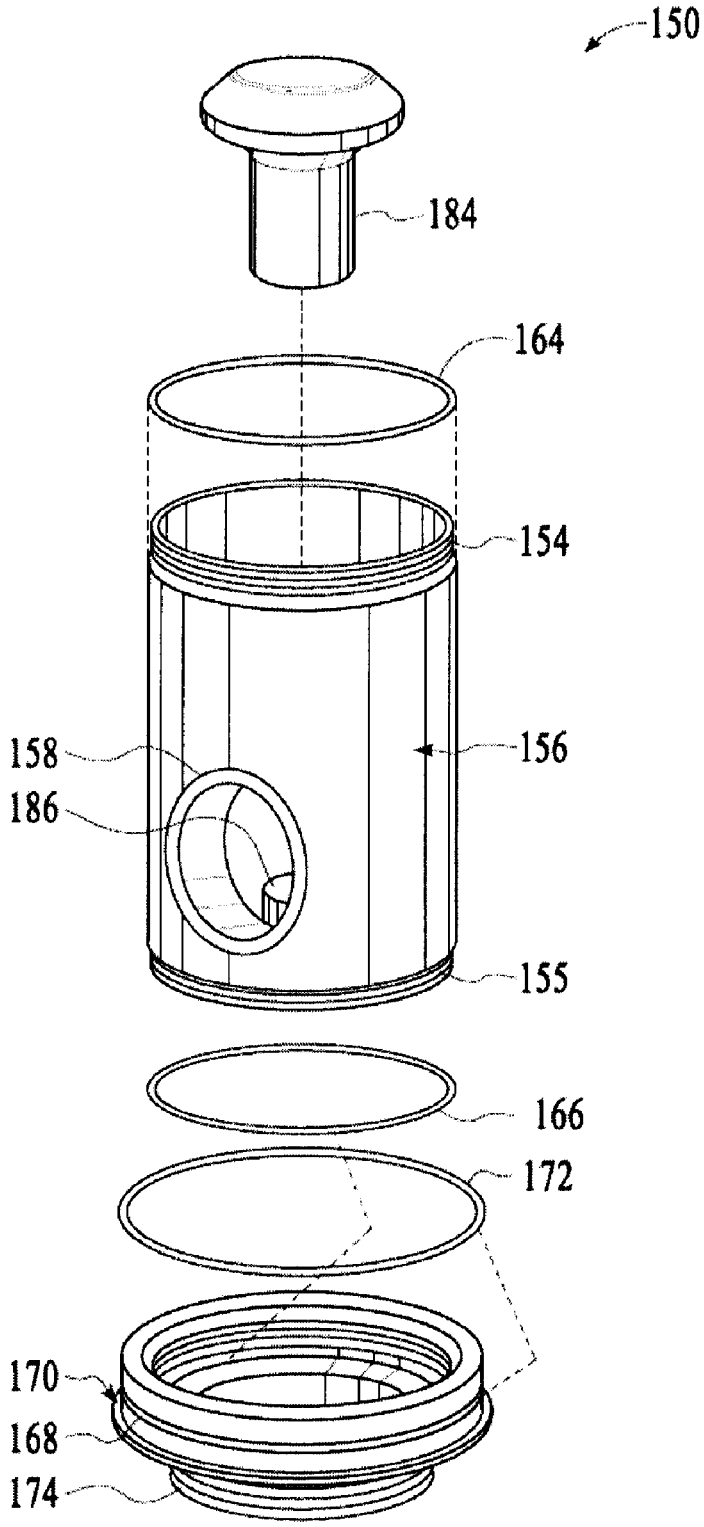
FIG. 8 illustrates an exploded perspective view of the automatic overflow valve portion of the automatic drain device of FIG. 4

Turning now to FIGS. 7 and 8, the valve body 126 of the manual drain valve 120 and the valve body 156 of the automatic drain valve 150 are shown as tubular-shaped and generally hollow. The top end of valve body 126 has fixed thereto an upper coupling 130 to connect or affix to the mounting hardware 104. The upper end of the valve body 126 also has at least one bypass port 132 formed therein. The bypass port 132 permits water rejected from the closed manual drain valve 120 to flow into the area between the valve sleeve 102 and the valve bodies 126, 156.

The manual drain valve 120 further includes a valve seat 134 and poppet 136 mounted in valve body 126. The valve seat 134 may be level with or below the lower end of the bypass port 132. When the drain cover 108 is pressed down, the passage through the valve seat 134 is closed by poppet 136. The addition of water will raise the level and amount of water in the sink.

As shown in FIG. 8, the valve body 156 of the automatic drain valve 150 includes a threaded top end 154 and a threaded bottom end 155. The top end 154 is intended to receive an o-ring 164 or other sealing mechanism to couple and seal the connection of the top end 154 to a threaded bottom end of the manual valve body 126. The valve body 156 further includes an inlet port 158 to receive the overflow water therein from the bypass port 132.

The valve body 156 further includes a lower coupling 170. The interior of the lower coupling 170 is threaded to mate and receive the threaded bottom end 155. The connection is sealed with an o-ring 166 or other sealing mechanism. O-ring 164 is intended to be recessed in a corresponding groove (not shown) in the interior of the lower coupling 170. The center of the lower coupling 170 is open to permit water to flow therethrough. The lower coupling 170 can connect to the plumbing system via threads 174 to transport drain water to a public utility system or septic system.

Turning briefly back to FIG. 6, the valve sleeve 102 (shown partially) is secured to the automatic drain 100 by fixing it between the upper coupling 130 and the lower coupling 170. As shown in FIG. 7, an o-ring 162 seats in a groove (not shown) around the upper coupling 130. Another o-ring 172 seats in a groove 168 around the lower coupling 170. The two O-rings 162, 172 seal the space between the valve sleeve 102 and the manual and automatic valve bodies 126, 156.

Figure 9:
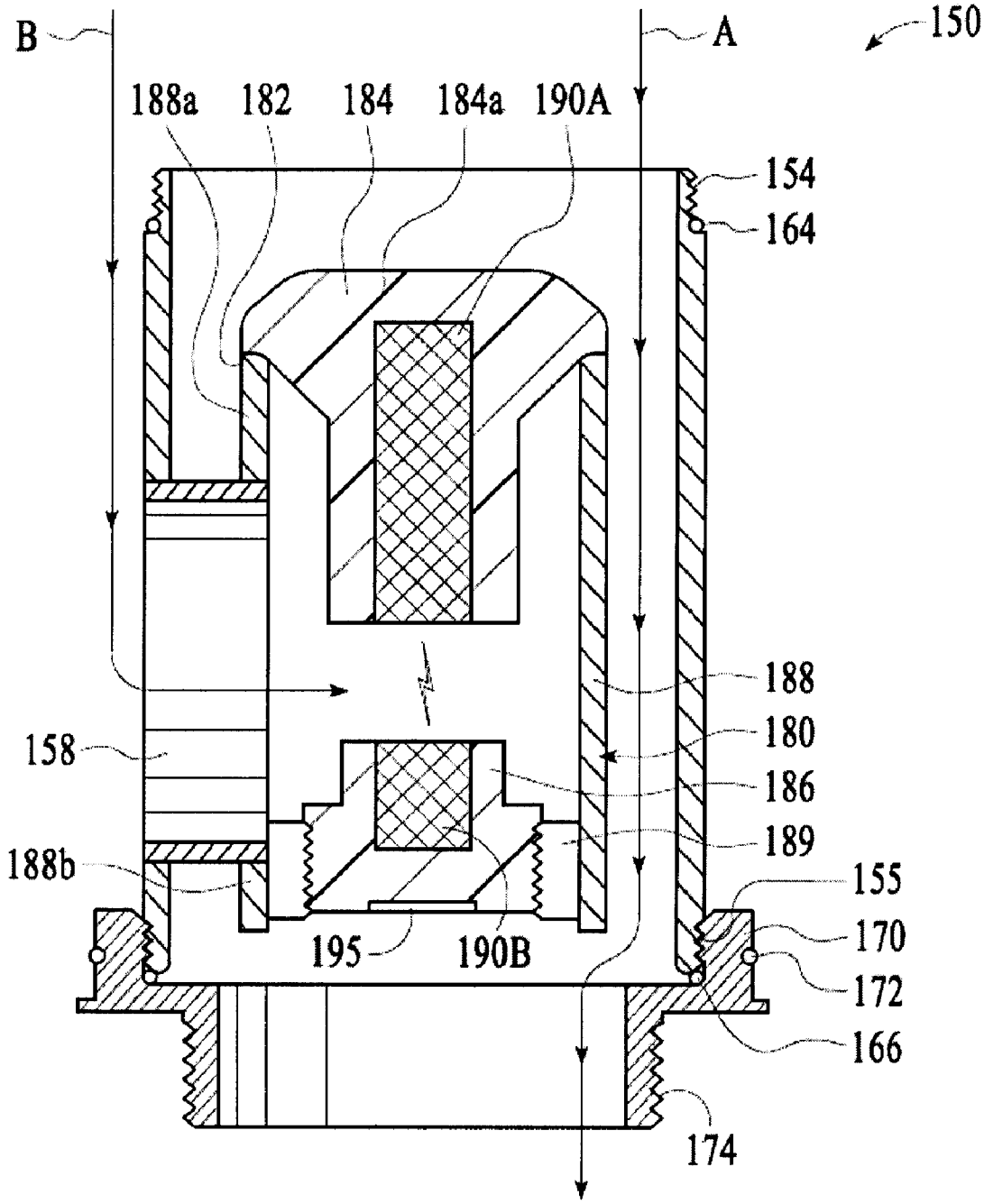
FIG. 9 illustrates a cross-sectional view of the automatic overflow valve portion of the automatic drain device of FIG. 4 with the manual drain open.

With specific reference to FIG. 9, a cross-sectional view of the automatic drain valve 150 is shown. The automatic valve body 156 transports water, represented by flow line A, from the manual valve body 126 when poppet 136 is open (as shown in FIG. 7). Flow line B represents water transported from the bypass port 132 through inlet port 158, also while poppet 136 is open.

The automatic drain valve 150 has a chamber 180 that has a float valve seat 182 at the upper end which is in communication with inlet port 158 to receive overflow water therethrough. Thus, the float valve seat 182 functions as an opening to pass water, and as a smooth surface against which float stopper 184 can seat.

Float stopper 184 in this embodiment is shaped generally like a rivet and is positioned above and in the upper opening of chamber 180. Float stopper 184 is generally comprised of at least two materials divided into a float body 184*a* and a float magnetic area 190A. However, it is possible to construct a float stopper of a single material. In the exemplary embodiment, the float body 184A is made of a polymer, plastic or other waterproof and durable material. Float magnetic area 190A comprises a magnet or ferrous material which is attracted to, or creates a magnetic force.

In FIG. 9, the automatic drain valve 150 is shown closed by float stopper 184 and float valve seat 182. Hence, the water represented by flow line A flows between the chamber 180 and automatic valve body 156. A float control magnet body 186 is located in the bottom of the chamber 180 and comprises a magnetic area 190B, external threads 188*b* and adjustment means 195. In the exemplary embodiment, the float control magnet body 186 is made of a polymer, plastic or other waterproof and durable material. Magnetic area 190B comprises a magnet or ferrous material which is attracted to, or creates a magnetic force.

As shown in FIG. 9, the chamber 180 includes a plurality of threads 189 which mate with the threads 188*b* of the float control magnet body 186. The mated threads 188*b*, 189 close the bottom of chamber 180. The back of float control magnet body 186 has an adjustment means 195 which provides a means for moving the body 186 up or down in the chamber 180. In the exemplary embodiment, the adjustment means 195 is a slot or means to receive a screw driver or other tool to turn or rotate the body 186 via the threads 188*b*.

The distance from the magnetic area 190B to the magnetic area 190A determines the water safety level in the sink. Closing the distance, by raising 190B, strengthens the magnetic force and allows a higher water level in the sink, while increasing the distance, by lowering 190B, weakens the magnetic force and allows a lower water level in the sink.

Figure 10:
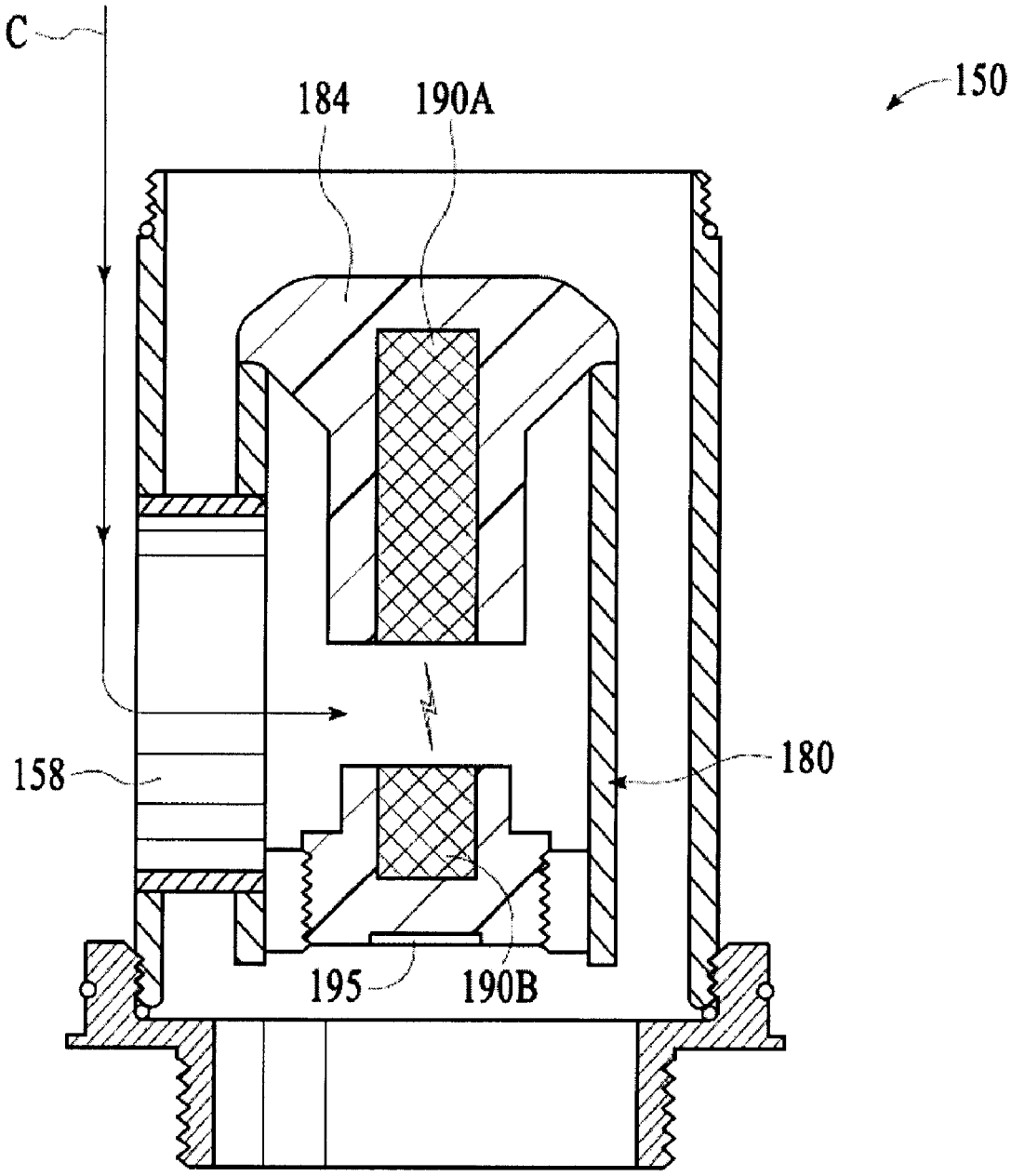
FIG. 10 illustrates a cross-sectional view of the automatic overflow valve portion of the automatic drain device of FIG. 4 with the manual drain closed and the fluid level in the sink at a safe level.
Figure 11:
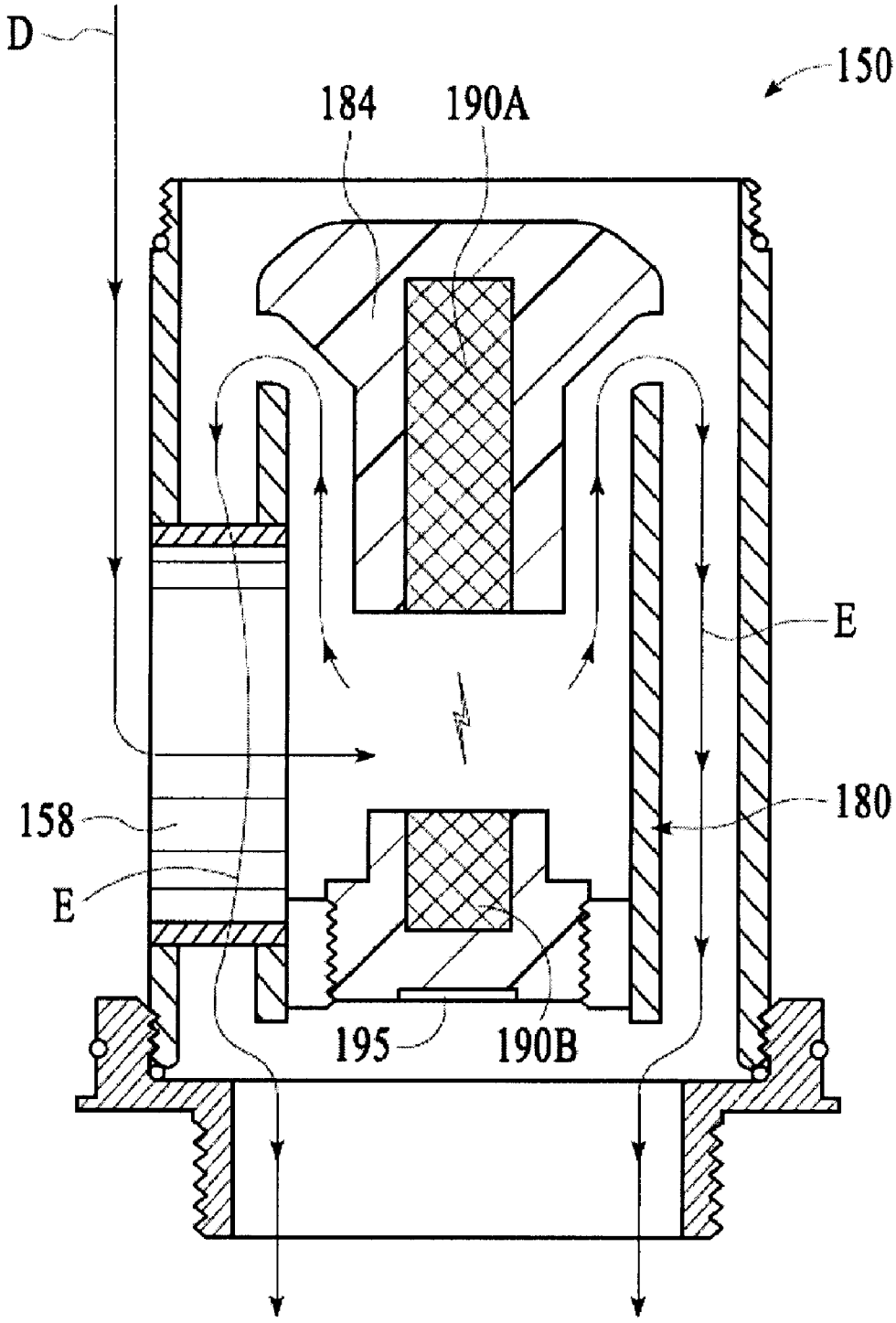
FIG. 11 illustrates a cross-sectional view of the automatic overflow valve portion of the automatic drain device of FIG. 4 with the manual drain closed and the fluid level in the sink at an overflow level.

As shown in FIG. 10, the manual drain valve 120 is closed and water in the sink is diverted through the inlet port 158. This bypass flow is shown by flow line C. As shown in FIG. 11, if the level of water in the sink is above the safety level, the overflow water (shown by flow line D) exerts a buoyancy pressure sufficient to overcome the magnetic force between 190A and 190B, the water will lift the float stopper 184 away from the float valve seat 182. Thus, water (shown by flow line E) will rise up through the chamber 180 and flow over the float valve seat 182. The water flow E will then pass downward through the space between the inside of the automatic valve body 156 and the outside of the chamber 180, into the drain pipe.

Once the level of water in the sink decreases below the safety level, the magnetic attraction between 190A and 190B will overcome the buoyancy pressure exerted by the overflow water and the float stopper 184 will re-seat against the float valve seat 182.

Figure 12:
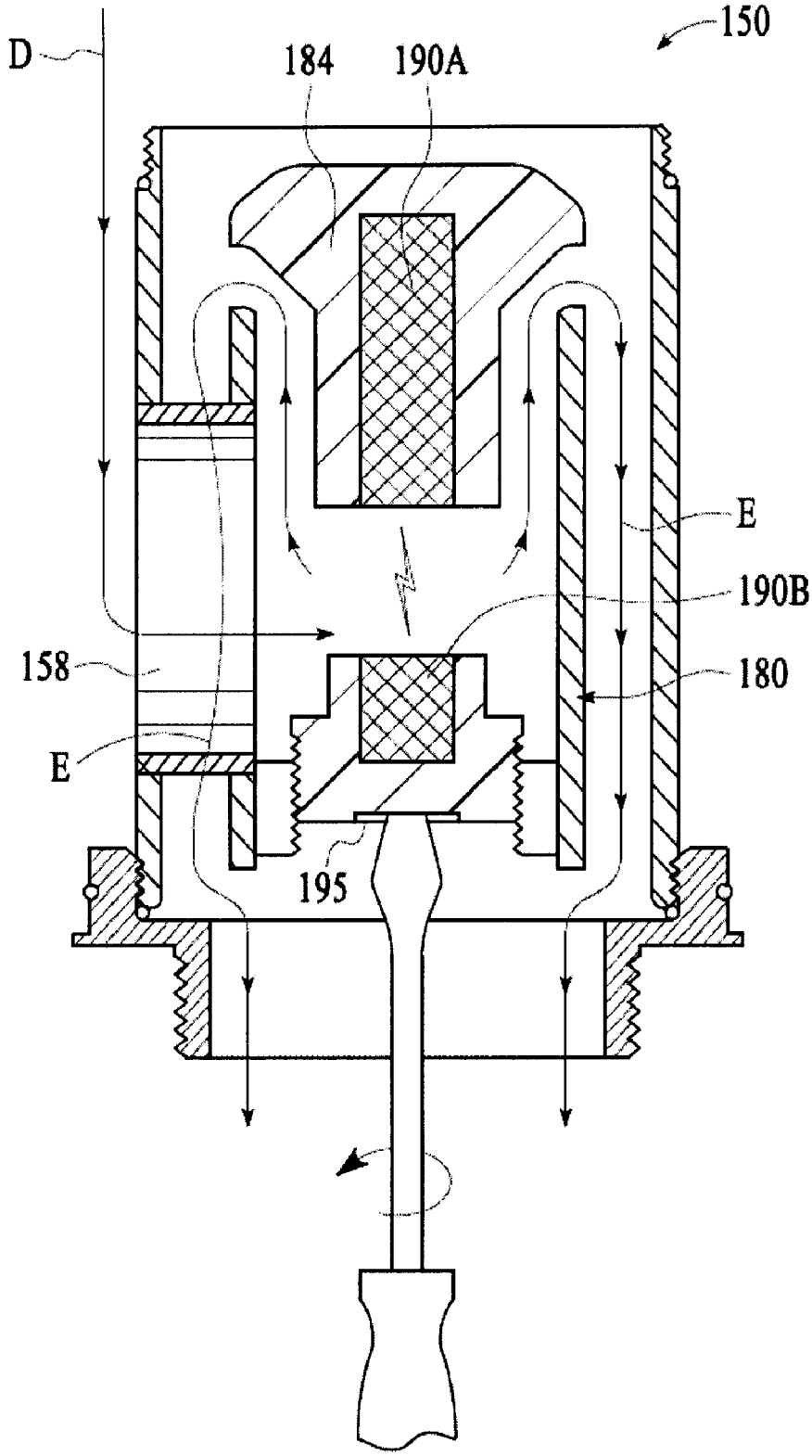
FIG. 12 illustrates the cross-sectional view of FIG. 11 with an adjustment being made to overflow level.

FIG. 12 shoes an additional cross sectional view of the automatic drain 100 FIG. 11 with the adjustment means 195 which is operable by a screwdriver to extend the magnetic area 190B upwards, thereby increasing the amount of water the sink will hold.

The float stopper is shown as a ball or a rivet-shape in the figures but the float stopper can have other shapes that are effective to stop the flow, such as, for example, wedge, conical, mushroom, tapered cylinder and the like. The float stopper may be comprised of a single or multiple materials which may include plastics, rubbers, foams, metals, metal-plastic composites, and other like durable and compliant materials. In addition, the float stopper may be attached to the automatic valve body by a hinge, tether, strap, or the like. The materials used to construct the valve bodies include metal, plastic or other sufficiently rigid materials.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples described herein but is to be accorded the widest scope consistent with the principles and novel features disclosed herein.

The invention claimed is:

1. An automatic sink drain overflow prevention device comprising:

a manual drain valve having an open position and a closed position, the closed position being configured to prevent fluid drain to a drain pipe, the manual drain valve comprising:

an elongated valve stem, a drain cover coupled to the valve stem at a first end, a poppet coupled to the valve stem at a second end, a valve body comprising a valve seat designed to sealingly mate with said poppet and a support member designed to slidingly support the valve stem, the valve body being configured to attach to a sink drain hole at a first end and a to a drain pipe at a second end, the valve body further comprising at least one bypass port located adjacent said valve body first end and above said valve seat; and an automatic drain valve in fluid communication with said bypass port and said drain pipe, the automatic drain valve being operable to automatically open a bypass drain path for passage of overflow fluid from the sink to the drain pipe when the manual drain valve is in the closed position and an overflow level of fluid is in the sink, the automatic drain valve comprising:

a float valve seat operable to pass the overflow fluid to the drain pipe; and a float stopper shaped to sealingly mate with the float valve seat when the bypass drain path is closed; and a magnet operable to magnetically attract the float stopper to close against said float valve seat, thereby shutting off the flow of overflow fluid therethrough.

2. The device of claim 1, the manual drain valve further comprising a spring surrounding the valve stem and a hinged mechanism capable of allowing the manual drain valve to be opened and closed by popping the valve stem and poppet in and out by pressing and re-pressing the drain cover.

3. The device of claim 1, wherein the automatic drain valve further comprises a water level adjustment mechanism capable of changing a distance between the magnet and the float stopper.

4. The device of claim 1, wherein the float stopper automatically separates from the float valve seat when the fluid in the sink generally creates an overflow pressure sufficient to lift the float stopper from the magnet, thereby opening the bypass drain path and allowing the overflow fluid to bypass the manual drain valve and enter the drain pipe.

5. The device of claim 3, wherein the automatic drain valve can be set by the water level adjustment mechanism such that the sink has a safe water level corresponding to a safe pressure insufficient to separate the float stopper from the float valve seat, thereby closing the bypass drain path and preventing the fluid from bypassing the manual drain valve and entering the drain pipe.

6. The device of claim 1, wherein the sink lacks an overflow drain hole.

7. The device of claim 1, wherein the bypass drain path is at least partially comprised of a sleeve with a first end fitted to a first coupling at the manual drain valve and with a second end fitted to a second coupling at the automatic drain valve.

8. The device of claim 7, wherein the bypass drain path is formed between the sleeve, and the automatic and manual drain valves.

9. The device of claim 8, wherein the automatic sink drain overflow prevention device further comprises an air breather inlet configured to transfer air from outside the sleeve to inside the drain pipe at a location below the manual drain valve seat.

10. An automatic drain device for a sink comprising:

a manual drain valve having an open position and a closed position, the closed position being configured to prevent fluid drain to a drain pipe; and an automatic drain valve in fluid communication with said sink and said drain pipe, the automatic drain valve being operable to automatically open a bypass drain path for passage of overflow fluid from the sink to the drain pipe when the manual drain valve is in the closed position and an overflow level of fluid is in the sink, wherein the automatic drain valve comprises:

a float valve seat operable to pass the overflow fluid to the drain pipe;

a magnetically-controlled float stopper; and a magnet operable to magnetically attract the float stopper to close against said float valve seat, thereby shutting off the flow of overflow fluid therethrough.

11. The device of claim 10, wherein the manual drain valve comprises:

a spring-loaded stem;

a drain cover coupled to the stem at a first end; and a poppet coupled to the stem at a second end.

12. The device of claim 10, wherein the automatic drain valve further comprises a water level adjustment mechanism.

13. The device of claim 12, wherein the water level adjustment mechanism is operable to change the distance between the float stopper and the magnet.

14. The device of claim 10, wherein the float stopper separates from the float valve seat when the overflow fluid in the sink generally creates an overflow pressure sufficient to lift the float stopper from the magnet, thereby opening the bypass drain path and allowing the overflow fluid to bypass the manual drain valve and enter the drain pipe.

15. The device of claim 10, wherein the automatic drain valve can be set by the water level adjustment mechanism such that the sink has a safe water level corresponding to a safe pressure which is insufficient to separate the float stopper from the float valve seat, thereby closing the bypass drain path and preventing the fluid from bypassing the manual drain valve and entering the drain pipe.

16. The device of claim 10, wherein the sink lacks an overflow drain hole.

17. The device of claim 10, wherein the sink is a glass vessel without an overflow drain hole.

18. The device of claim 10 further comprising:

a bypass line attached to the manual drain valve at a first end and to the automatic drain valve at a second end, the first end being attached to the manual drain upstream from the manual drain valve seat; and a return line attached to the automatic drain valve at a first end and to the drain pipe at a second end, the second end being attached to the drain pipe downstream from the manual drain valve seat.

19. The device of claim 10, wherein the float stopper is shaped from one of a sphere, a hemisphere, a cone, a rivet, a mushroom and an egg shape.

20. The device of claim 10, wherein the automatic drain valve further comprises an air inlet downstream from the float valve seat.

21. A method for automatically draining fluid from a sink comprising the steps of:

closing a manual drain valve to prevent water in the sink from draining into a drain pipe, wherein the manual drain valve comprises:

an elongated valve stem, a drain cover coupled to the valve stem at a first end, a poppet coupled to the valve stem at a second end, a valve body comprising a valve seat designed to sealingly mate with said poppet and a support member designed to slidingly support the valve stem, the valve body being configured to attach to a sink drain hole at a first end and to a drain pipe at a second end, the valve body further comprising at least one bypass port located adjacent said valve body first end and above said valve seat; and a spring surrounding the valve stem and a hinged mechanism capable of allowing the manual drain valve to be opened and closed by popping the valve stem and poppet in and out by pressing and re-pressing the drain cover;

allowing water to accumulate in the sink;

automatically opening a bypass path to the drain pipe through an automatic valve when the water in the sink is at or above an overflow condition, the automatic valve comprising:

a float valve seat operable to pass the overflow fluid to the drain pipe;

a float stopper shaped to sealingly mate with the float valve seat; and a magnet operable to magnetically attract the float stopper to close against said float valve seat, thereby shutting off the flow of overflow fluid therethrough.

* * * * *